US007051403B2

(12) United States Patent
Homberg

(10) Patent No.: US 7,051,403 B2
(45) Date of Patent: May 30, 2006

(54) ELECTROMECHANICAL SWING LEAF OPERATOR

(75) Inventor: Jürgen Homberg, Hagen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 253 days.

(21) Appl. No.: 10/467,759

(22) PCT Filed: Feb. 11, 2002

(86) PCT No.: PCT/EP02/01389

§ 371 (c)(1),
(2), (4) Date: Aug. 13, 2003

(87) PCT Pub. No.: WO02/064932

PCT Pub. Date: Aug. 22, 2002

(65) Prior Publication Data

US 2004/0064917 A1 Apr. 8, 2004

(30) Foreign Application Priority Data

Feb. 13, 2001 (DE) ..... 101 07 051

(51) Int. Cl.
*E05F 15/12* (2006.01)
*E05F 3/10* (2006.01)

(52) U.S. Cl. ..... 16/62; 16/79

(58) Field of Classification Search ..... 16/79, 16/62, 68, 69, 64, 50, 82, DIG. 9, DIG. 17, 16/322, 354, 382, DIG. 21
See application file for complete search history.

(56) References Cited

U.S. PATENT DOCUMENTS

| | | | | |
|---|---|---|---|---|
| 633,682 | A | 9/1899 | Cliff | |
| 1,359,144 | A | 11/1920 | Angell | |
| 2,933,755 | A | 4/1960 | Carlson | |
| 3,875,612 | A * | 4/1975 | Poitras | 16/48.5 |
| 4,263,694 | A * | 4/1981 | Jentsch | 16/48.5 |
| 4,763,385 | A | 8/1988 | Furch et al. | |
| 4,937,913 | A * | 7/1990 | Jentsch | 16/58 |
| 4,937,914 | A | 7/1990 | Harrison et al. | |
| 5,943,736 | A | 8/1999 | Kürkkäinen et al. | |
| 6,262,548 | B1 * | 7/2001 | Scholten et al. | 318/445 |
| 6,681,444 | B1 * | 1/2004 | Breed et al. | 16/82 |

FOREIGN PATENT DOCUMENTS

| | | |
|---|---|---|
| DE | 41 24 283 A1 | 1/1993 |
| FR | 966.945 | 5/1948 |
| GB | 2116251 A * | 9/1983 |
| GB | EP 0612906 A1 * | 8/1994 |

* cited by examiner

*Primary Examiner*—Robert J. Sandy
*Assistant Examiner*—Andre' L. Jackson
(74) *Attorney, Agent, or Firm*—Cohen, Pontani, Lieberman & Pavane

(57) ABSTRACT

The invention relates to an electromechanical swing leaf operator having a door closer (1) with an eccentrically supported pinion (6) that presents a circular rolling curve and meshes with a toothed rack (5) being disposed at a piston (4), whereby a particular execution of the rolling curve and of the teeth (9) of the toothed rack (5) in adaptation to a toothing of the pinion (6) is achieved. With the intention to realize an optimized moving course of the piston (4) in the housing (2) of the door closer (1) an improved execution of the delayed closing operation is provided.

20 Claims, 11 Drawing Sheets

Schnitt A-A

Schnitt A-A

ELECTROMECHANICAL SWING LEAF OPERATOR

PRIORITY CLAIM

This is a U.S. national stage of application No. PCT/EP02/01389, filed on 11 Feb. 2002. Priority is claimed on that application and on the following application: Country: Germany, Application No.: 101 07 051.9, Filed: 13 Feb. 2001.

BACKGROUND OF THE INVENTION

1. Field of the Invention

The invention relates to an electromechanical swing leaf operator with a door closer.

2 Description of the Related Art

DE 41 24 282 02 describes an electromechanical swing door operator, in which an electrical motor—if necessary with an in-line integrated clutch drives a gear, which is directly, or with an in-line integrated gear train, connected with a closing shaft of a door closer. In this case, the door closer can be executed as overhead door closer with a slide arm assembly. As the electrical motor acts, via a gear train or several gear trains, directly on the closing shaft of the door closer, additional pulse encoders, clock members, detectors and limit switches controlling the electrical motor are required for the realization of the required opening- and closing characteristics.

Furthermore manually operable overhead door closers with slide arm assembly are known in which a piston, being guided in a housing and leaning against a closing spring, is provided, wherein a toothed pinion arranged at the closing shaft meshes with a toothed rack of the piston.

Above mentioned overhead door closers with slide arm assembly, also known as rack and pinion door closers, with regard to traditional door closers, advantageously do not present an arm assembly protruding uncovered into the room, but they simply present an actuation arm sitting close and flat at the door frame or at the door leaf and cooperating with a sliding member that is slidably located in a slide rail. They do, however, bear the disadvantage that the actuation arm, sitting close and flat at the door frame or at the door leaf, leads to an unfavourable course of forces at the door, in relation with conventional, symmetric rack and pinion mechanics. It is therefore an object to conceive an optimal rack and pinion drive, with the intention to achieve, during the opening procedure and closing procedure of the door, a progression of the pinion, as low in friction and smooth as possible, at the associated toothed rack and therefore of the piston inside the piston housing, which circumstance simultaneously corresponds to an ideal course of the momentum.

Centrically or eccentrically supported pinions are used in known door closers.

A door closer having an eccentrically supported pinion is known from U.S. Pat. No. 5,943,736, wherein the toothing of the toothed rack forms a linearly extending pitch line of engagement having an angle comprised between 4.5° and 7.2° with regard to the moving direction of the piston. The selection of an angle depends on the size of the door closer, respectively on the strength of the closing spring. Because of the eccentric support of the pinion and of the linear course of the toothed rack, an optimal, especially low friction and smooth progression of the pinion's teeth at the toothed rack is not guaranteed; there are spreads in the course of the momentums' curves.

A comparable solution applying a linearly extending toothed rack with an angle is described in U.S. Pat. No. 633,682.

Furthermore DE 36 45 313 C2 and DE 36 45 314 C2 reveal an eccentrically supported pinion where a rolling curve, arranged at the pinion, is used, having various lever arms in relation to the rotary axis. Accordingly, the rolling curve of the associated toothed rack extends in an arcuate form.

In a door closer known from DE 82 17 72 02 respectively from the French Patent Application 96 69 45, the closer shaft is connected at an eccentrically supported elliptical toothed wheel meshing with an inclined toothed rack on the piston side. Up to a certain degree, a transmission, adapted to a desired course of the momentum, is achieved by means of the elliptical gear due to the differently long lever arms of the elliptical toothed wheel.

The pneumatic door closer according to U.S. Pat. No. 1,359,144 presents a circular eccentrically supported pinion which meshes with an uneven toothed rack at the piston. The circular pinion is provided with a regular toothing on a circular rolling curve, whereby varying lever arms come into effect due to the eccentrical support.

Various piston drive embodiments in door closers are described in DE 36 38 353 A1 in EP 0 207 251 A2, in DE 94 12 64 and in U.S. Pat. No. 2,933,755, whereby in relation with eccentrically or centrically supported pinions—if necessary with in-line arrangement of a transmitting gear drive—a direct charge of the closing spring is exerted by means of a crank drive.

Centrically supported pinions are known from EP 0 056 256 A2 as well as from U.S. Pat. No. 4,937,914. EP 0 056 256 A2 deals with a door closer, the pistons thereof presenting two symmetrically, diametrically opposite toothed racks, whereby a centrically supported pinion engages, in the closing position, with shortened teeth, in both toothed racks of the piston.

The door closer according to U.S. Pat. No. 4,937,914 presents a centrically supported pinion, which presents teeth extending at the circumference, with progressively increasing depths of teeth, which teeth engage between the rods of a correspondingly curve-shaped extending toothed rack.

A substantially centrically supported pinion of a drive for a door or for a window is disclosed in DE 44 44 131 A1 and DE 44 44 133 A1, wherein the pinion itself presents a toothing over up to approximately half the circumference thereof, the teeth thereof being disposed at lever arms varying in length and progressing on a correspondingly curved rolling curve of a toothed rack.

SUMMARY OF THE INVENTION

The object of the invention is, when using an electromechanical drive for the opening procedure of the connected door, whereby the closing procedure should not be performed by the electromechanical drive, but by a power storage (power transmission unit), to provide a small and inexpensive swing leaf operator that guarantees the same required opening and closing characteristics as an overhead door closer with slide arm assembly does, i.e. to optimize the course of movements of the piston of the door closer during the opening and the closing procedures within the door closer housing, i.e. to guarantee especially a jam-free and therefore low friction progression of the pinion at the toothed rack of the piston. By using a pinion having an appropriate rolling curve, the pinion's cost of production should be minimized, whereby, compared to known toothed racks, a particular embodiment of the toothed rack, due to the intended low friction to be achieved, should result in a longer lasting working life and in higher efficiency, which in return allows for using a weaker closing spring. In execution of the invention an improvement of the closing characteristics of the overhead door closer with slide arm assembly should be achieved additionally through an improved oil exchange from the piston chamber to the spring chamber during the closing procedure.

According to the invention it is used either an arrangement comprising substantially individual modules: a door closer, a gear and a motor or comprising an entity, which includes in a housing: a motor, a gear and a power transmission unit, whereby the power transmission unit includes the functions of a door closer. In this case, at the power transmission unit or at the door closer, a toothed rack respectively the teeth thereof are adapted in an optimum way to the course of a toothing of a pinion while respecting the eccentrical support thereof and the circular rolling curve thereof, such that a smooth transition to each following adjacent tooth is guaranteed, during the opening procedure as well as during the closing procedure. This applies particularly to the portion of the pinion exceeding the rotation of 1800.

When a separate door closer is used, it will present a two-sided axle exit, whereby one axle exit is used for the connection of a lever, which via a sliding member cooperates with a sliding rail, and the opposite axle exit with a power transmission member is connected, in an already known manner, with the gear of a corresponding motor.

In this case, the gear may be flanged directly or indirectly to the door closer. Furthermore it is conceivable to utilize here a corresponding mounting plate, which allows for separately placing the individual modules, such as door closer gear and motor, in order to guarantee flexible exchange in case of a defect of individual modules.

Furthermore it is likewise possible to accommodate the above described individual modules, such as the door closer, the gear and the motor, in an aggregate bloc, whereby in this case the internal structure of the door closer and the one of the power transmission unit are the same or may appear as acting the same. In this case, it has proven to be advantageous that the opening-sided teeth's flank angle of the toothed rack be executed substantially in ascending manner up to approximately half the length of the toothed rack, and subsequently they be executed substantially in a constant or descending manner, whereby the descending course contributes to improving the low friction.

The decreasing course contributes in this case to improve the reduction in friction.

The rotation of the pinion, from the closing position up to the maximum opening position, may comprise more or less than approximately 180°, without having any negative influence on the required effectiveness. It is essential in this case that the closing-sided tooth profiles of the last teeth of the toothed rack in the opening direction, arranged in the portion adjoining the 180°, be executed with an angle or rounded.

In execution of the invention basically optional tooth forms may be used; i.e. the pinion and/or the toothed rack may present teeth with straight, angled or convex curved tooth profiles. However, it has proven to be advantageous—especially for reasons regarding production techniques—to attribute substantially a spur toothing to the toothed rack and an involute toothing to the pinion.

With the intention to achieve optimized closing characteristics, the invention includes furthermore an improvement of the oil exchange between the piston chambers separated by the piston.

Depending on the application field of the swing leaf operator, different closing phases may be associated to the closing procedure of the connected door. These may include for example two or four closing phases with different speeds at the door leaves. For example four closing phases have shown the most comfort.

Accordingly, the closing procedure comprises four closing phases, each closing phase, while including a certain tolerance, being associated in an already known manner to one closing angle. The first closing phase, as well as the third one, may be controlled through a single valve by means of the longitudinal groove that is arranged in the skirt of the piston such that the attainable low friction course of the pinion at the toothed rack is assisted by an advantageous embodiment of the oil exchange from the piston chamber to the spring chamber during the closing procedure, whereby a commonly required valve for the third closing phase is abandoned.

A swing leaf operator of this type is considered as opening support, whereby, however, the closing procedure of the door is realized, for example, by the above described door closer. A door closer, equipped with a cam disc, may be likewise used, the drive motor, however, requires considerably higher performance, which would forcibly lead to increasing the price and to increasing the dimension of the swing leaf operator.

DETAILED DESCRIPTION OF THE PRESENTLY PREFERRED EMBODIMENTS

Figure 1:
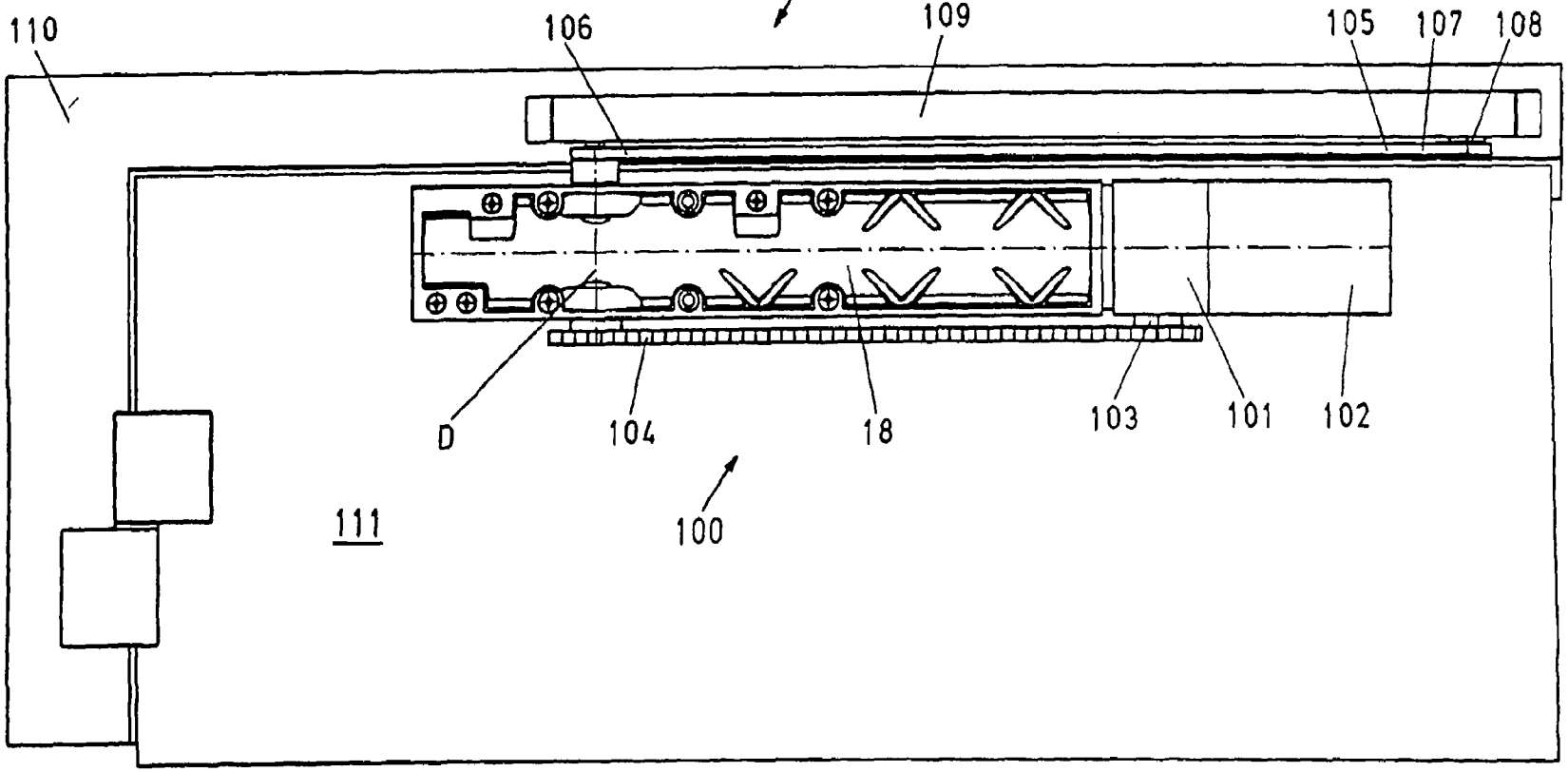
FIG. 1 shows a diagrammatical front view of an electromechanical swing leaf operator.

FIG. 1 shows the diagrammatical illustration of an electromechanical swing leaf operator 100, whereby, in the illustrated embodiment example, a drive means is disposed at the door leaf 111 and a sliding rail 109 is disposed at a door frame 110. The drive presents an electric motor 102 acting upon a gear 101. A gear exit shaft 103 is connected with a rotary axis D of a pinion 6, not illustrated in FIG. 1, (see FIG. 4), via gear traction 104 executed as a chain, a cable or a toothed belt. According to the FIGS. 2 to 4, the pinion 6 is guided in a piston 4, likewise not illustrated in FIG. 1, which is loaded through a closing spring 3 disposed in a spring chamber 18. At the rotary axis D of the pinion 6, a free end 106 of an arm 105 is pivitable, while its other free end 107 is guided, by means of a sliding member 108, in the sliding rail 109. It is to be understood that, if the dimensional ratios are appropriate, the sliding rail 109 can be located at the door leaf 111 and the drive can be located at the door frame 110.

Figure 2:
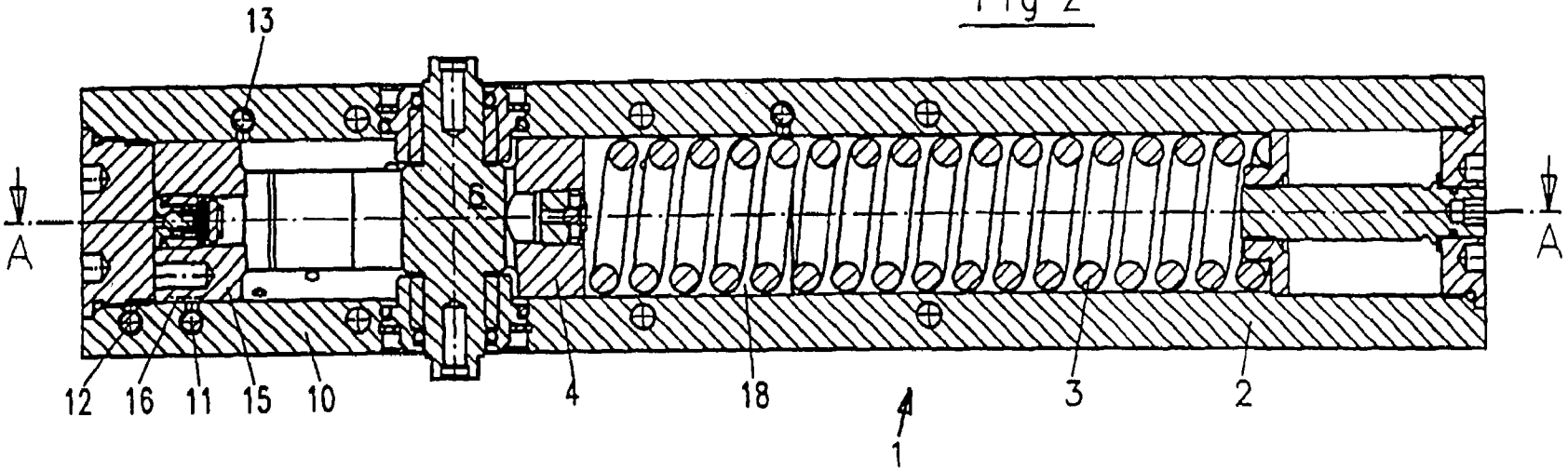
FIG. 2 shows a vertical section through a closer housing.
Figure 3:
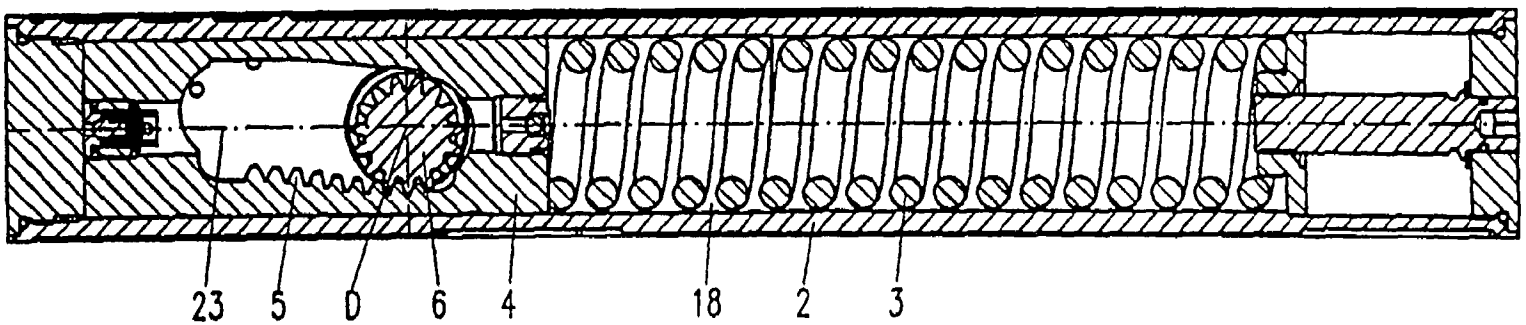
FIG. 3 shows a section according to line A—A according to FIG. 1.
Figure 4:
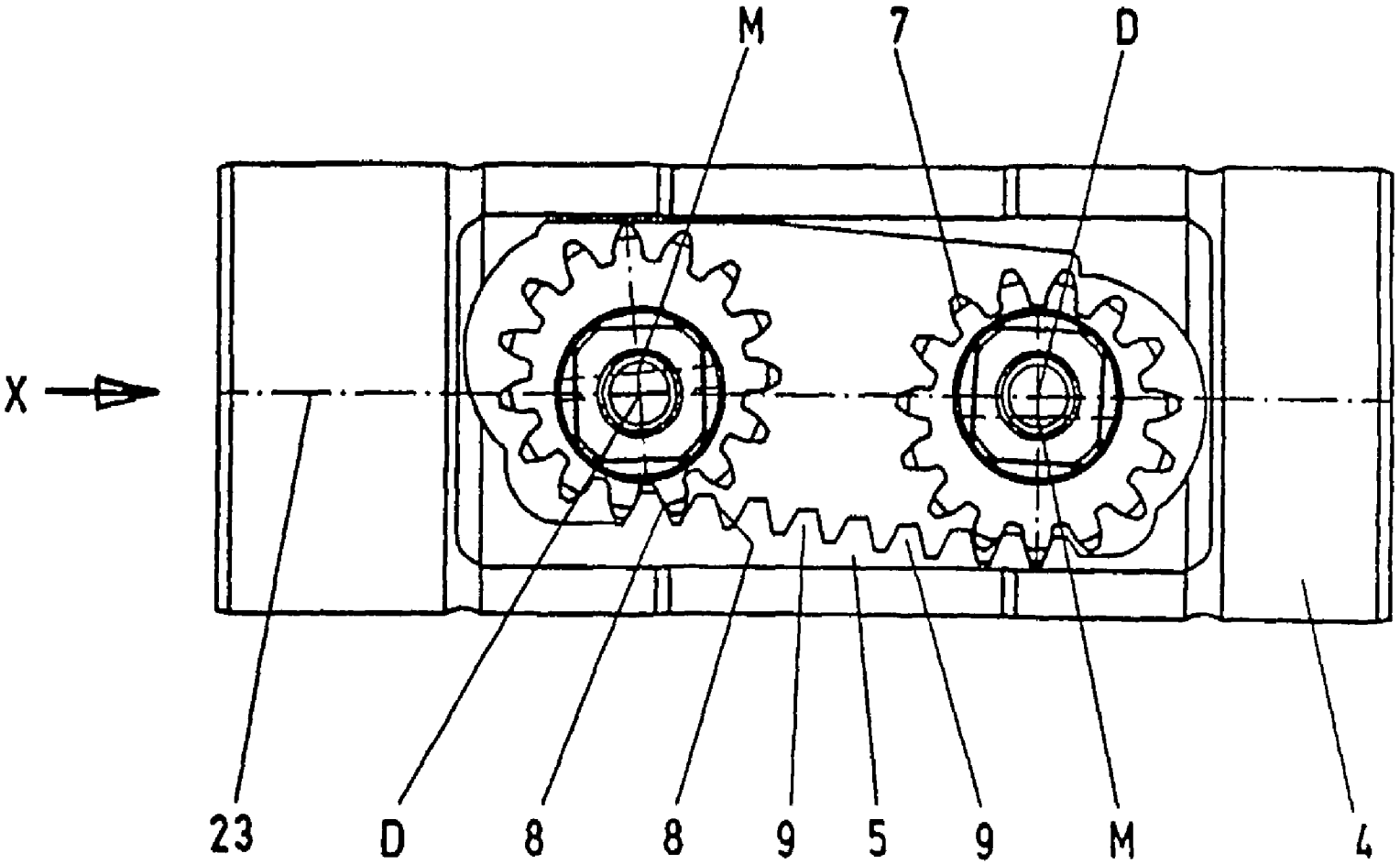
FIG. 4 shows a plane view on the piston including two final positions of the pinion.

According to FIGS. 2 to 7, a closing spring 3 acts on a piston 4 which is guided in a housing 2 of a door closer. As illustrated in FIGS. 3 and 4, the piston 4 has a toothed rack 5 meshing with the pinion 6, which presents an involute toothing 7. In the region of the center longitudinal axis 23, the pinion 6 is eccentrically supported on the rotary D, whereby in the closing position of pinion 6, illustrated on the right in FIG. 4, a central point M of the rolling circle of pinion 6 is offset into the direction towards the toothed rack 5, and in the opening position, illustrated on the left in FIG. 4, the central point M of the rolling circle of pinion 6 is offset into the opposite direction. The rolling curve of pinion 6, as can be seen, is circular. The teeth of a toothed rack 5 present opening-sided tooth profiles and closing-sided tooth profiles, wherein the closing-sided tooth profiles 8 of the last two teeth 9 are executed with an angle. The tooth profiles of all the other teeth 9 present a straight course. The aforementioned measure guarantees that during a movement of piston 4 in the direction of arrow X (opening direction) when the pinion 6 progresses on the toothed rack 5, even in the region, in which the pinion 6 has slightly exceeded the rotation about 180°, a low friction mating of the involute toothing 7 with the teeth 9 of toothed rack 5 is realized. By the way, the rolling curve of the toothed rack 5 is adapted to the eccentrical support of pinion 6 and presents a correspondingly slightly S-shaped course, wherein all teeth 9 of the toothed rack 5 present different flank angles on the opening-side and on the closing-side.

Figure 5:
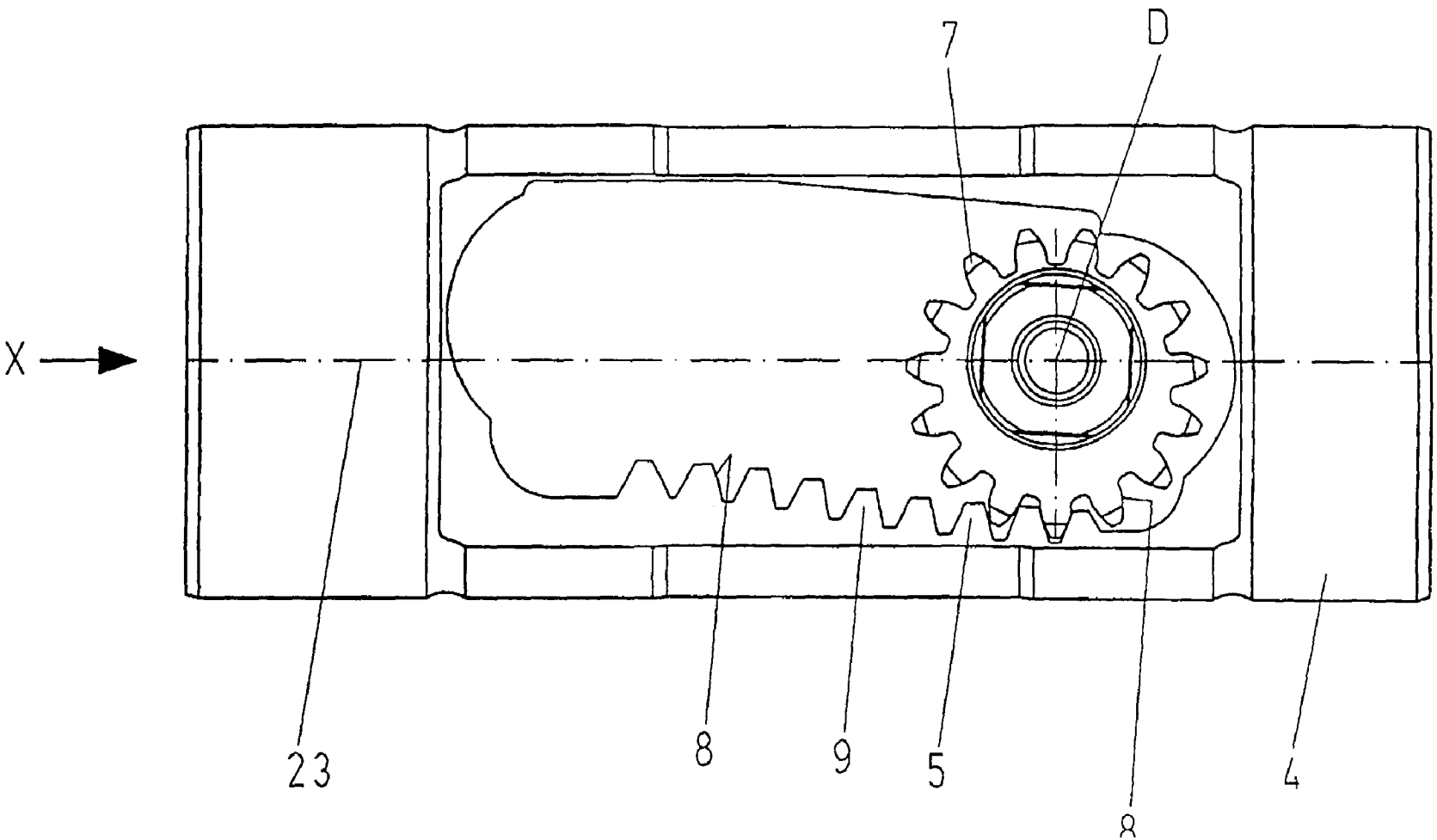
FIGS. 5 to 7 show three phases of the course of the pinion at a toothed rack
Figure 6:
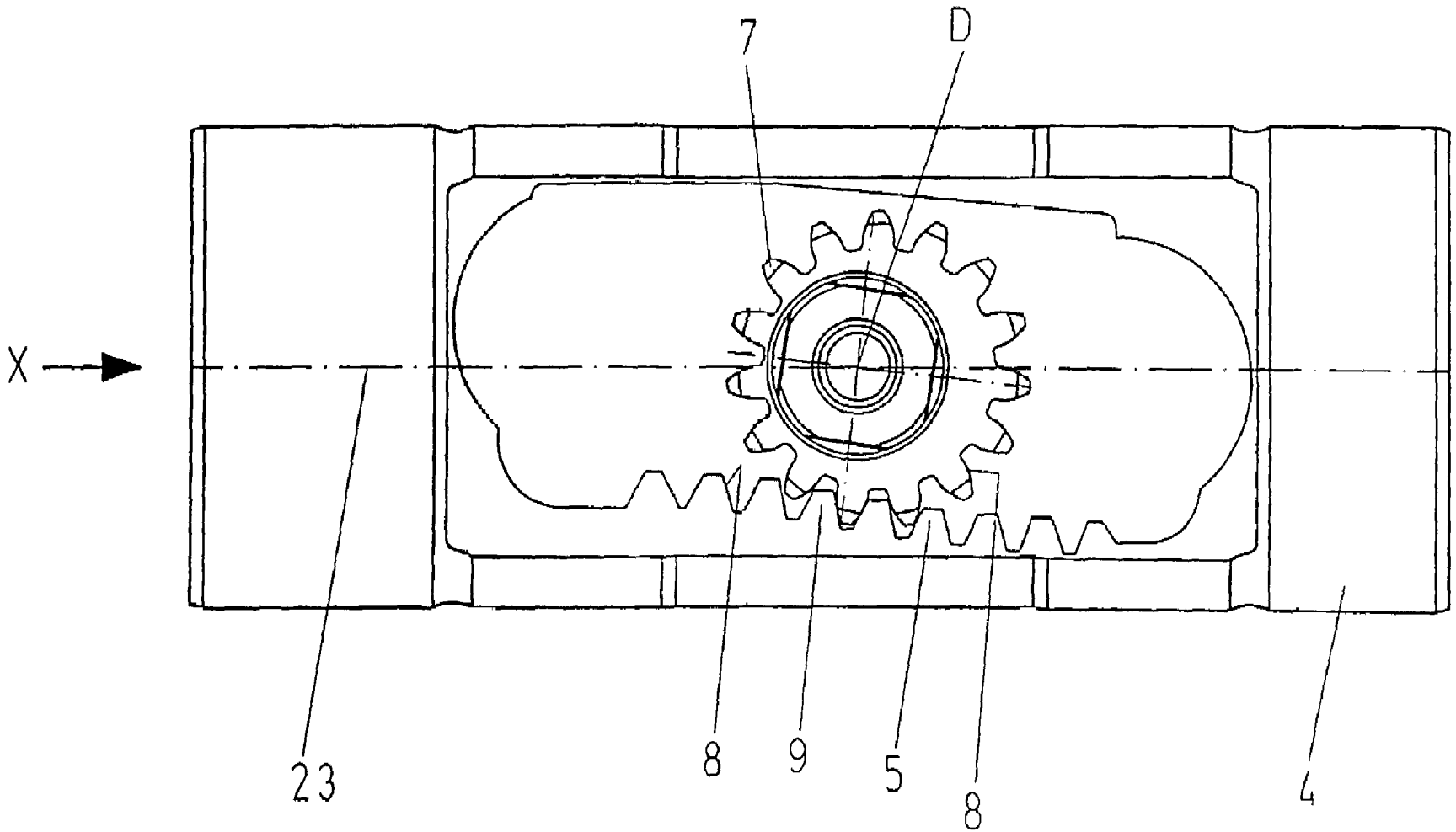
Figure 7:
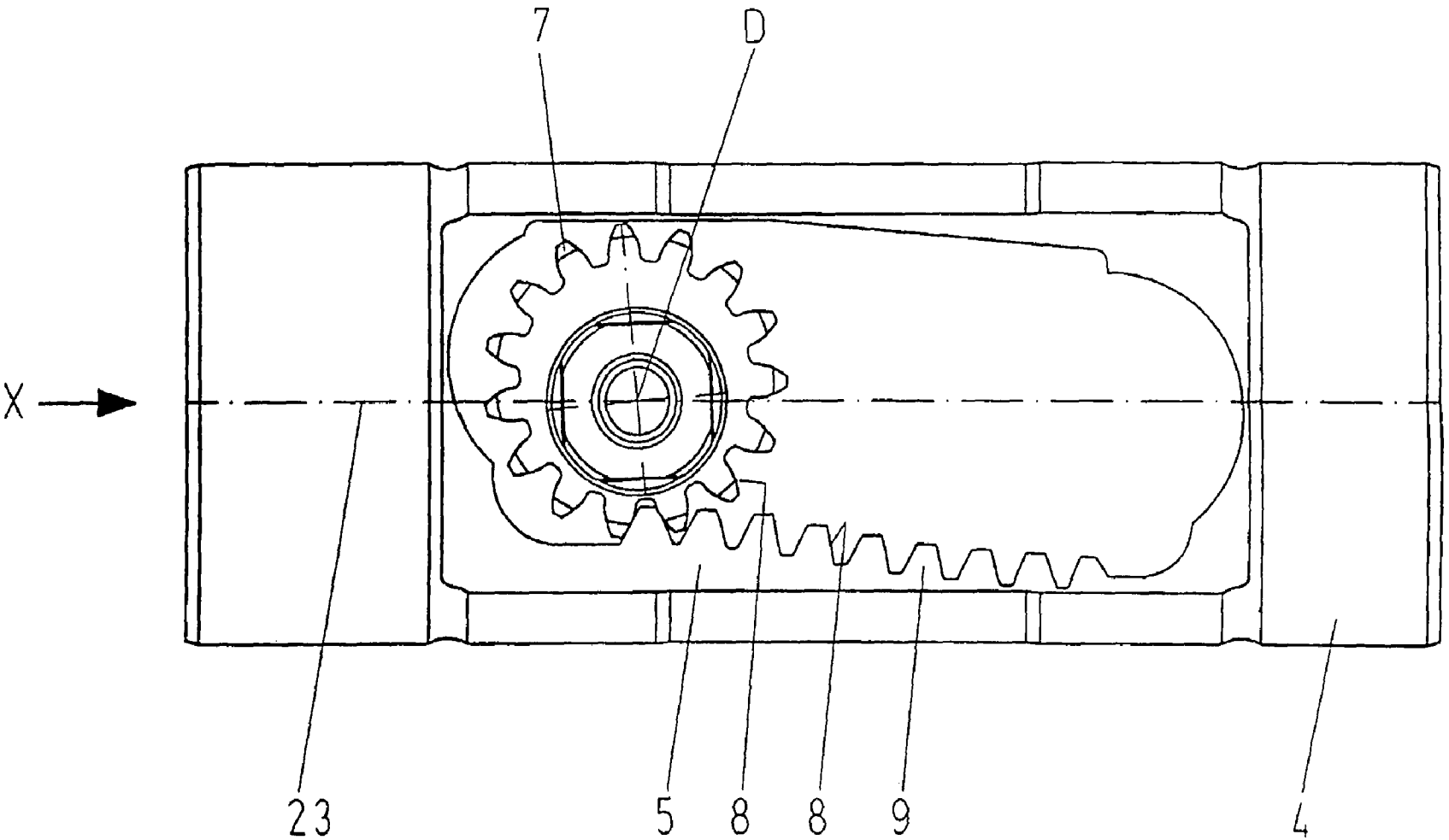

Respectively separated positions of pinion 6 are illustrated in the FIGS. 5 to 7. In this case, FIG. 5 illustrates the closing position, i.e. when the door is closed, namely the position of the piston 4 and of the pinion 6. In this case, the pinion 6 is located in the right zone of the aperture of piston 4. In this case, the rotary axis D is located on the center longitudinal axis 23. If the piston 4 is moved into the opening direction (direction of arrow X), the pinion 6 will rotate about the rotary axis D. Due to the eccentricity of pinion 6, a position arranged almost in a central region can be seen in FIG. 6, position that corresponds to a certain opening position of the door. Through the progression of pinion 6 at the toothed rack 5, the piston 4 has moved further into the opening direction.

A final position of the pinion 6, corresponding to the maximum opening side of the door, which is not illustrated, is represented in FIG. 7. These three FIGS. 5 to 7 clearly show the course of the eccentrically supported pinion with an involute toothing, wherein simultaneously likewise the constant mating of the teeth 7 of pinion 6 with the toothed rack 5 with its teeth 9 can be appreciated.

As especially shown in FIG. 2 and in FIGS. 8 to 11, three control valves 11, 12, and 13, serving the delayed closing operation, are disposed in the housing walls 10 of the door closer 1, and the functions thereof will be explained hereinafter on the basis of FIGS. 8 to 11.

It is pointed out, for the reason of completeness that instead of the door closer I another device may be used, for example a power transmission unit having the same or the same operating inner structure as a door closer or an overhead door closer with slide arm assembly.

Figure 8:
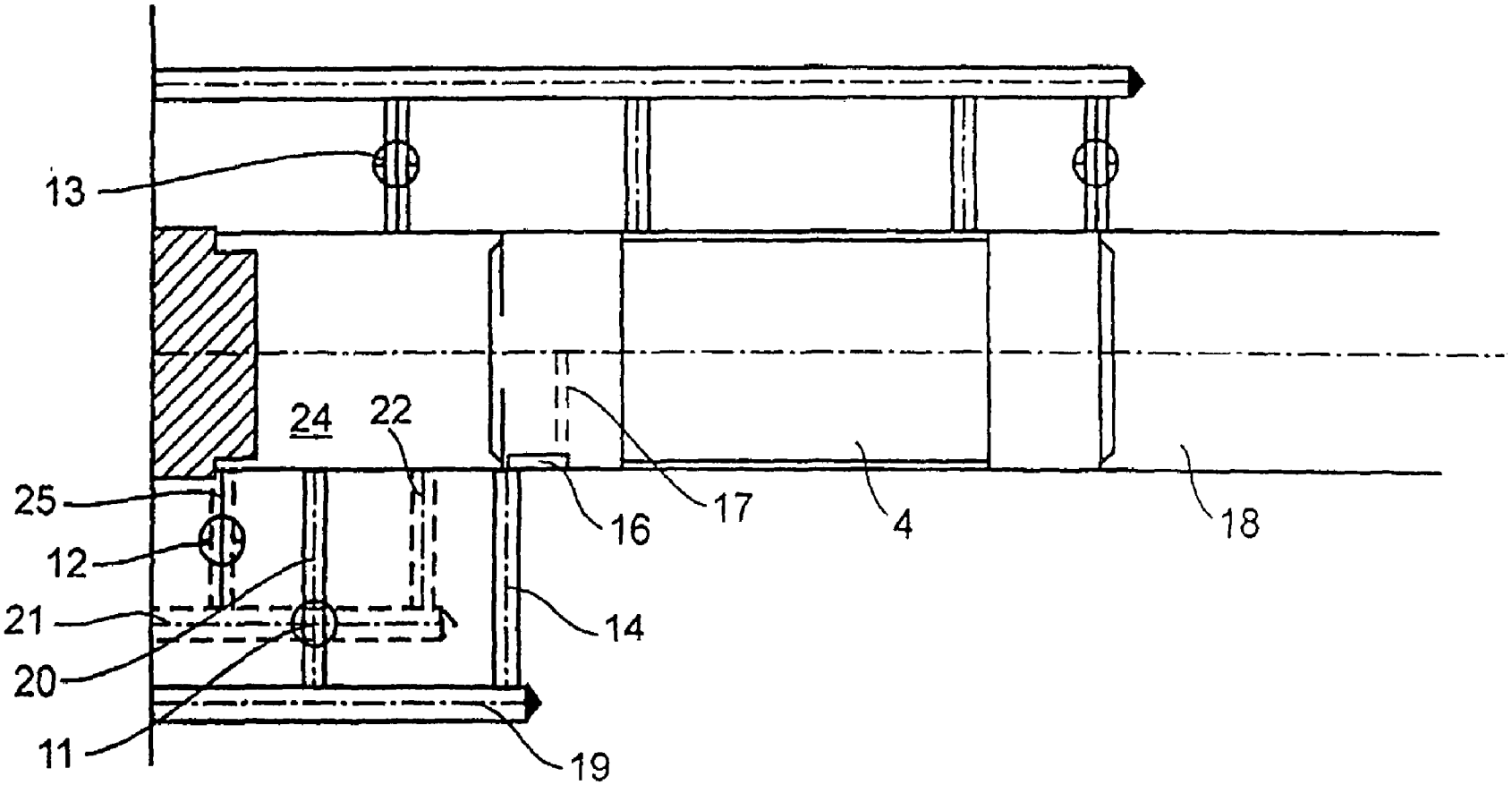
FIGS. 8 to 11 show, in a diagrammatic illustration, four positions of the piston during the delayed closing operation.

During the start of the closing procedure according to FIG. 8, the piston 4 passes an oil outlet duct 14, which, via a duct 19, is connected with a control valve 11 and via a duct 20 with a piston chamber 24. The oil exiting the piston chamber 24, via a longitudinal groove 16 in the skirt of the piston 15 and a radial borehole 17 in the piston 4, can pass over into the spring chamber 18. The ducts 25, 21, and 22, associated to the control valve 12 are arranged in another plane.

Figure 9:
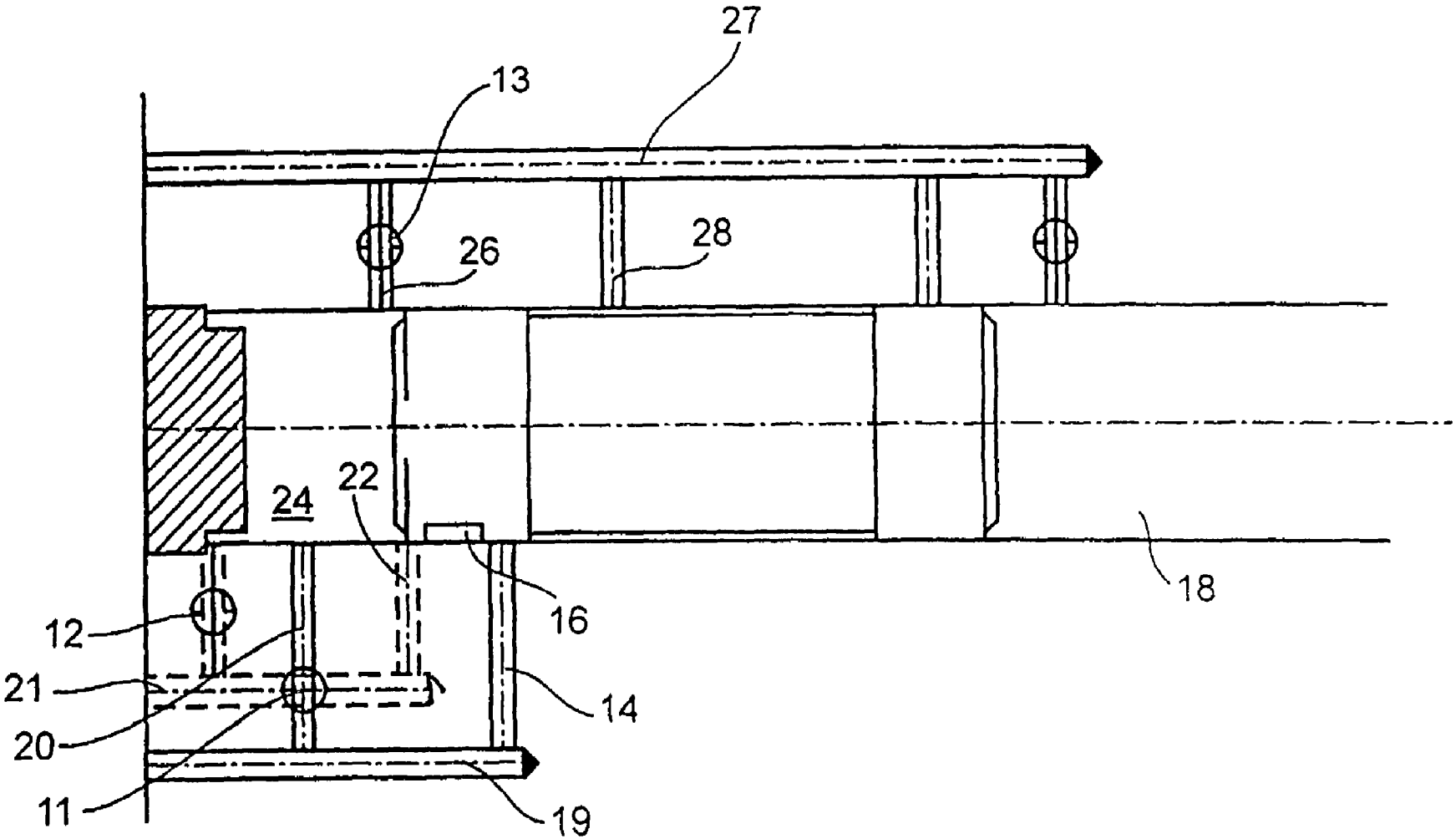
Figure 10:
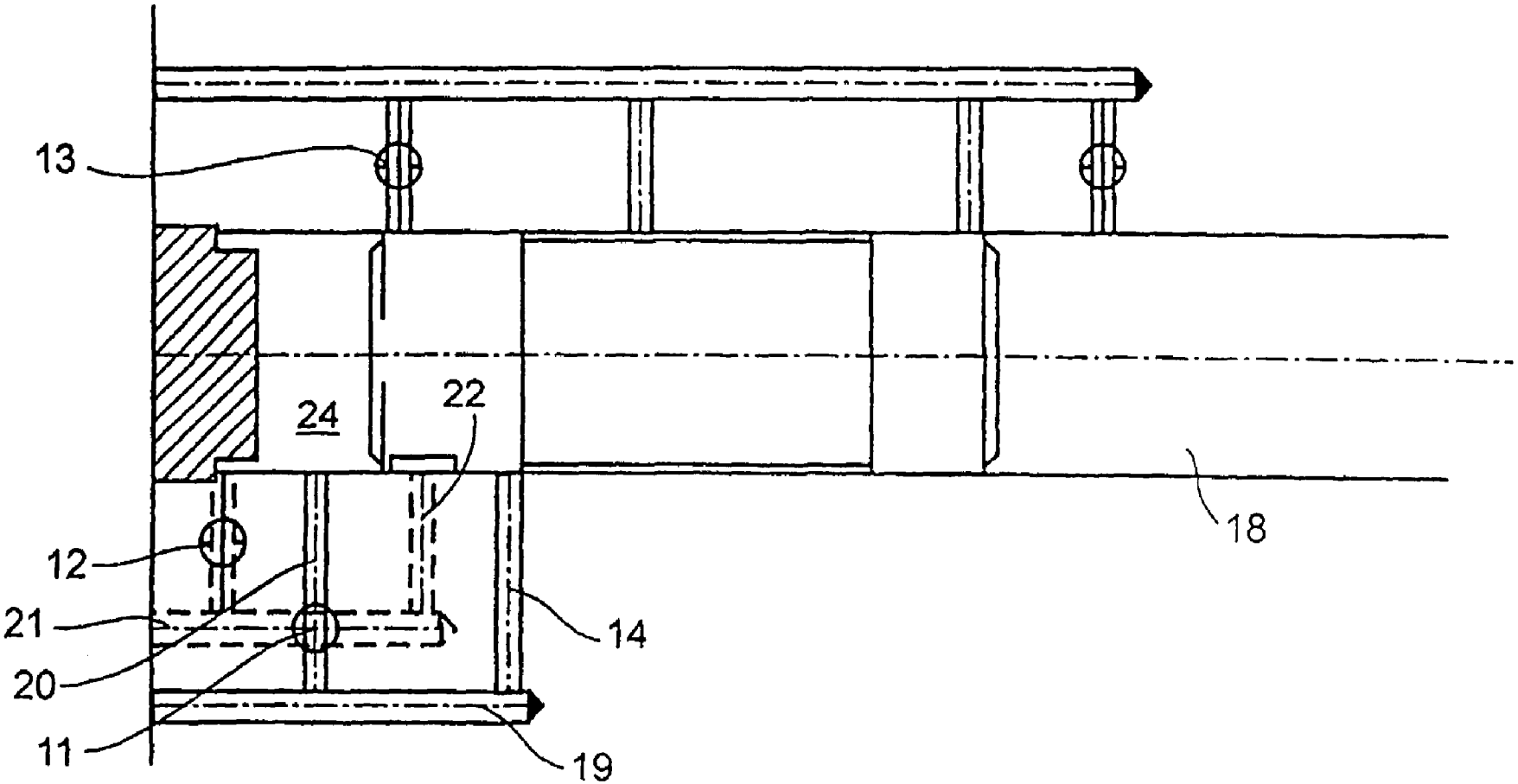

According to FIG. 9, the longitudinal groove 16 has passed the duct 14, such that an oil transfer, from the piston chamber 24 to the spring chamber 18, is only possible due to the play between the piston 5 and the housing wall 10, resulting in a strong delay of the closing speed (second phase of the delayed closing operation).

During the third phase of the delayed closing operation, illustrated in FIG. 10, the oil passes again from the piston chamber 24, via the duct 20 and the same control valve 11 as well as the ducts 19 and 14 into the region of a not specifically illustrated overflow edge of piston 4, into the spring chamber 18. As the same control valve 11 is involved, the closing speed is identical in the first and in the third delaying phase.

Figure 11:
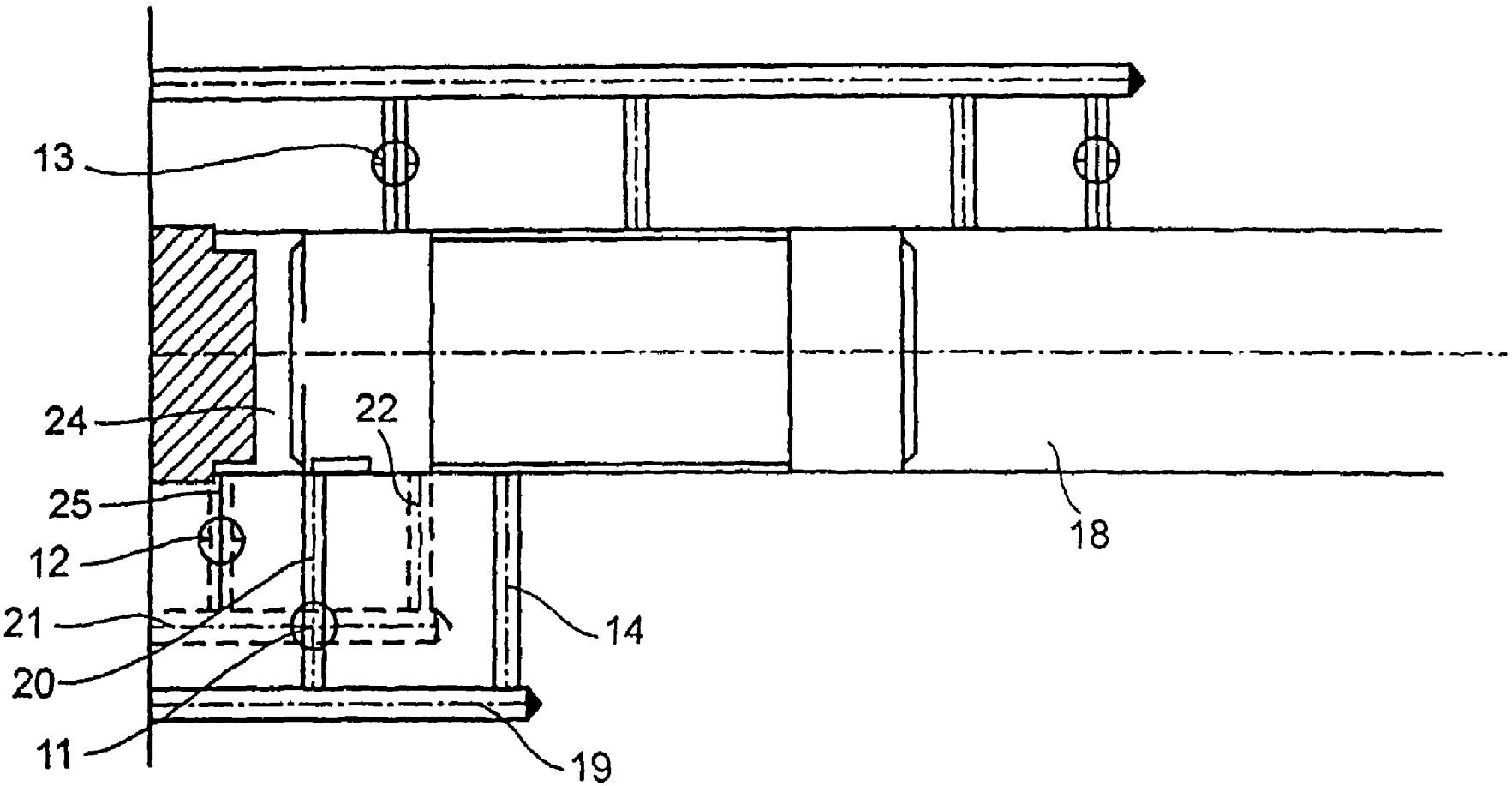

During the fourth phase of the delayed closing operation (beginning of the closing region), illustrated in FIG. 11, the duct 20 of the valve 11 leading to the piston chamber 24 is closed; in this case the oil coming from the piston chamber 24 passes, via the duct 25, the control valve 12, the duct 21, and the duct 22 via the afore mentioned overflow edge, into the spring chamber 18. The control valve 13, is normally closed during the delayed closing operation; there is, however, the possibility of reducing the delaying period, through corresponding opening of this valve during the second closing phase (during which an oil exchange happens only through leakage between the piston and the housing walls), whereby the oil exiting the piston chamber 24 is conducted, while being reduced, via the duct 26, the control valve 13, the duct 27, and the duct 28, into the spring chamber 18.

Figure 12:
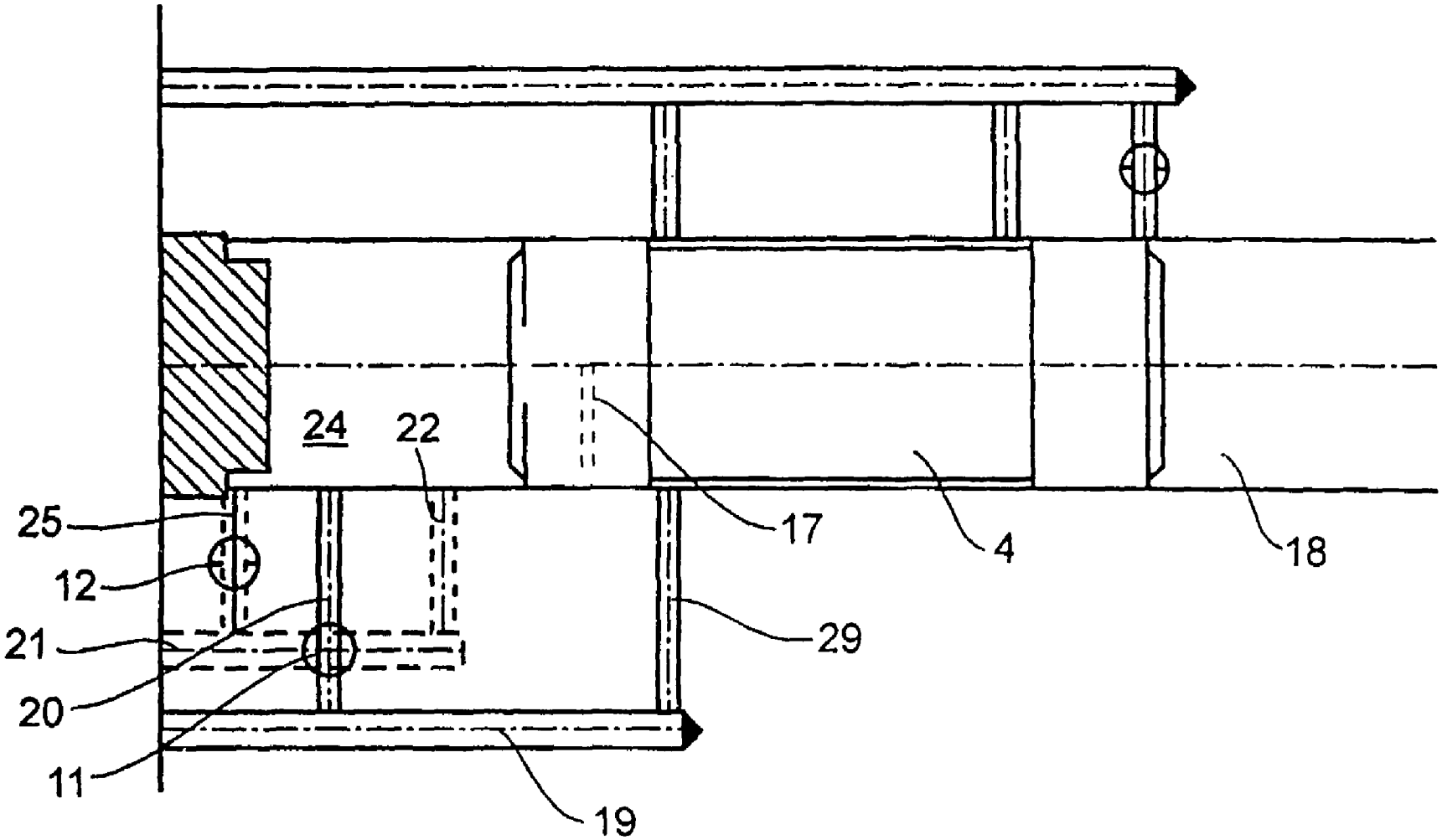
FIG. 12 shows a second possibility of the delayed closing operation.

An alternative embodiment with regard to the execution of the oil outlet ducts and the valves for controlling the closing procedure is illustrated in FIG. 12. In this alternative embodiment only two different closing phases are realized, such that a modification with regard to the above described four closing phases is possible. Therefore, only the valves 11 and 12 are required. The oil outlet duct 19 is extended and leads into an oil outlet duct 29 ending behind the not specifically designated overflow edge of piston 4 in the region of the toothed rack 5.

Besides the above described two embodiment examples with regard to different closing phases of the connected doors, it is of course possible, within the scope of the invention, to realize a different number of closing phases having various closing speeds.

REFERENCES

1 door closer
2 housing
3 closing spring
4 piston
5 toothed rack
6 pinion
7 involute
8 closing-sided tooth profiles
9 teeth of the toothed rack
10 housing walls
11 control valve
12 control valve
13 control valve
14 oil outlet duct
15 skirt of the piston
16 longitudinal groove

17 radial bore hole
18 spring chamber
19 oil outlet duct
20 oil outlet duct
21 oil outlet duct
22 oil outlet duct
23 center longitudinal axis
24 piston chamber
25 oil outlet duct
26 oil outlet duct
27 oil outlet duct
28 oil outlet duct
29 oil outlet duct
100 swing leaf operator
101 gear
102 electrical motor
103 gear exit shaft
104 gear train
105 arm
106 free end
107 free end
108 sliding member
109 slide rail
110 door frame
111 door leaf
M central point of the working circle of the pinion
D rotary axis of the pinion
x direction of the arrow in the opening direction

What is claimed is:

1. An electromechanical swing leaf operator comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant or decreasing, the closing side flank angle of the teeth decreasing up to approximately half the length of the toothed rack and subsequently increasing, the closing side tooth profile of the last teeth in the opening direction executed with an increased flank angle, the teeth having a width which increases up to approximately half the length of the toothed rack and subsequently decreases;

a spring urging said piston in the closing direction;

a toothed pinion supported for rotation about a rotary axis in said housing and having teeth which mesh with the teeth of said rack, said pinion being eccentrically mounted and having a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack;

an electric motor which drives said pinion via a gear; and a control valve arrangement which reduces the closing speed of the piston as the piston moves toward said closing position, wherein said control valve arrangement comprises a first control valve and a second control valve, said piston being moved in said closing direction in four phases comprising:

a first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

2. A swing leaf operator with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant, the closing side flank angle of the teeth decreasing up to approximately half the length of the toothed rack and subsequently increasing, the closing side tooth profile of the last teeth in the opening direction being executed with an increased flank angle;

a spring urging said piston in the closing direction;

a toothed pinion supported for rotation about a rotary axis in said housing and having teeth which mesh with the teeth of said rack, said pinion being eccentrically mounted and having a center point which, in the closing position, is offset from the rotary axis toward the toothed rack and, in the opening position, is offset from the rotary axis away from the toothed rack, said pinion rotating through less than 180 degrees from the closing position to the opening position;

an electric motor which drives said pinion via a gear; and a control valve arrangement which reduces the closing speed of the piston as the piston moves toward said closing position, wherein said control valve arrangement comprises a first control valve and a second control valve, said piston being moved in said closing direction in four phases comprising:

a first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

3. An electromechanical swing leaf operator comprising:

a housing comprising a piston chamber and a spring chamber;

a piston guided in said housing between a closing position in said piston chamber and an opening position in said spring chamber along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant or decreasing, the closing side flank angle of the teeth decreasing up to approximately half the length of the toothed rack and subsequently increasing, the closing side tooth profile of the last teeth in the opening direction executed with an increased flank angle, the teeth having a width which increases up to approximately half the length of the toothed rack and subsequently decreases, said piston having a skirt with a longitudinal groove which communicates with said spring chamber via a radial bore hole in the piston;

a spring urging said piston in the closing direction;

a toothed pinion supported for rotation about a rotary axis in said housing and having teeth which mesh with the teeth of said rack, said pinion being eccentrically mounted and having a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack;

an electric motor which drives said pinion via a gear; and a control valve arrangement which reduces the closing speed of the piston as the piston moves toward said closing position, said control valve arrangement comprising a first control valve in a first oil outlet duct which leads into said groove during a first phase of a delayed closing operation.

4. A swing leaf operator as in claim 3 wherein the teeth of at least one of said pinion and said toothed rack have teeth with one of straight, angled, and convexly curved tooth profiles.

5. A swing leaf operator as in claim 3 wherein said pinion has teeth with an involute profile.

6. A swing leaf operator as in claim 3 wherein said housing comprises a housing wall in which said control valve arrangement is located, said control valve arrangement comprising at least one control valve associated with two closing phases.

7. A swing leaf operator as in claim 3 wherein said control valve arrangement comprises said first control valve and a second control valve, said piston being moved in said closing direction in four phases comprising:

said first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

8. A swing leaf operator as in claim 3 wherein said first oil outlet duct communicates with said piston chamber via said first control valve.

9. A swing leaf operator as in claim 8 wherein said piston exhibits play with respect to said housing wall, said play enabling a pressure compensation between said piston chamber and said spring chamber during the second phase of the delayed closing operation.

10. A swing leaf operator as in claim 8 wherein said closing operation comprises a third closing phase, said piston having an overflow edge, said first oil outlet duct communicating between said piston chamber and said spring chamber via said first oil outlet duct and said overflow edge of said piston during said third closing phase.

11. A swing leaf operator as in claim 10 wherein said closing operation comprises a fourth closing phase, said first oil outlet duct being closed during said fourth closing phase, said control valve arrangement further comprising a second control valve in a second oil outlet duct, said piston chamber communicating with said spring chamber via said second oil outlet duct and said overflow edge during said fourth closing phase.

12. A swing leaf operator with a slide arm assembly, said slide arm assembly comprising:

a housing comprising a piston chamber and a spring chamber;

a piston guided in said housing between a closing position in said piston chamber and an opening position in said spring chamber along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant, the closing side flank angle of the teeth decreasing up to approximately half the length of the toothed rack and subsequently increasing, the closing side tooth profile of the last teeth in the opening direction being executed with an increased flank angle, said piston having a skirt with a longitudinal groove which communicates with said spring chamber via a radial bore hole in the piston;

a spring urging said piston in the closing direction;

a toothed pinion supported for rotation about a rotary axis in said housing and having teeth which mesh with the teeth of said rack, said pinion being eccentrically mounted and having a center point which, in the closing position, is offset from the rotary axis toward the toothed rack and, in the opening position, is offset from the rotary axis away from the toothed rack, said pinion rotating through less than 180 degrees from the closing position to the opening position;

an electric motor which drives said pinion via a gear; and a control valve arrangement which reduces the closing speed of the piston as the piston moves toward said closing position, said control valve arrangement comprising a first control valve in a first oil outlet duct which leads into said groove during a first phase of a delayed closing operation.

13. A swing leaf operator as in claim 12 wherein the teeth of at least one of said pinion and said toothed rack have teeth with one of straight, angled, and convexly curved tooth profiles.

14. A swing leaf operator as in claim 12 wherein said pinion has teeth with an involute profile.

15. A swing leaf operator as in claim 12 wherein said housing comprises a housing wall in which said control valve arrangement is located, said control valve arrangement comprising at least one control valve associated with two closing phases.

16. A swing leaf operator as in claim 12 wherein said control valve arrangement comprises said first control valve and a second control valve, said piston being moved in said closing direction in four phases comprising:

said first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

17. A swing leaf operator as in claim 12 wherein said first oil outlet duct communicates with said piston chamber via said first control valve.

18. A swing leaf operator as in claim 17 wherein said piston exhibits play with respect to said housing wall, said play enabling a pressure compensation between said piston chamber and said spring chamber during the second phase of the delayed closing operation.

19. A swing leaf operator as in claim 17 wherein said closing operation comprises a third closing phase, said piston having an overflow edge, said first oil outlet duct communicating between said piston chamber and said spring chamber via said first oil outlet duct and said overflow edge of said piston during said third closing phase.

20. A swing leaf operator as in claim 19 wherein said closing operation comprises a fourth closing phase, said first oil outlet duct being closed during said fourth closing phase, said control valve arrangement further comprising a second control valve in a second oil outlet duct, said piston chamber communicating with said spring chamber via said second oil outlet duct and said overflow edge during said fourth closing phase.

* * * * *